US007889876B2

(12) United States Patent
Hynd et al.

(10) Patent No.: US 7,889,876 B2
(45) Date of Patent: Feb. 15, 2011

(54) LOUDSPEAKER DRIVER ASSEMBLIES

(75) Inventors: Ian Hynd, Dunfermline (GB); Jordi F. Munoz, Dunfermline (GB)

(73) Assignee: SFX Technologies Limited, Dunfermline (GB)

( * ) Notice: Subject to any disclaimer, the term of this patent is extended or adjusted under 35 U.S.C. 154(b) by 1132 days.

(21) Appl. No.: 10/561,407

(22) PCT Filed: Jun. 17, 2004

(86) PCT No.: PCT/GB2004/002588

§ 371 (c)(1),
(2), (4) Date: May 2, 2006

(87) PCT Pub. No.: WO2004/114717

PCT Pub. Date: Dec. 29, 2004

(65) Prior Publication Data

US 2006/0233397 A1 Oct. 19, 2006

(30) Foreign Application Priority Data

Jun. 17, 2003 (GB) ..... 0314007.6

(51) Int. Cl.
*H04R 25/00* (2006.01)

(52) U.S. Cl. ..... 381/162; 381/152; 381/431

(58) Field of Classification Search ..... 381/152, 381/162, 386, 392, 431, 433, 306, 388; 181/173, 181/400
See application file for complete search history.

(56) References Cited

U.S. PATENT DOCUMENTS 3,925,627 A 12/1975 Ashworth
5,578,799 A * 11/1996 Callahan et al. ..... 181/137
6,332,029 B1 * 12/2001 Azima et al. ..... 381/152
6,463,157 B1 * 10/2002 May ..... 381/151
6,494,289 B1 * 12/2002 Bachmann et al. ..... 181/173
6,574,347 B1 * 6/2003 Linse ..... 381/431
6,788,794 B2 * 9/2004 Corsaro et al. ..... 381/152
6,965,679 B1 * 11/2005 Lopez Bosio et al. ..... 381/152
2002/0054690 A1 5/2002 Buos et al.
2004/0062405 A1 * 4/2004 Corsaro et al. ..... 381/152
2007/0058827 A1 * 3/2007 Topliss ..... 381/190
2007/0269076 A1 * 11/2007 Honda et al. ..... 381/411
2009/0316943 A1 * 12/2009 Frigola Munoz et al. .... 381/337

FOREIGN PATENT DOCUMENTS

WO WO 93/25053 12/1993
WO WO-01/72084 A2 9/2001

(Continued)

OTHER PUBLICATIONS

International Search Report dated Dec. 21, 2004.

*Primary Examiner*—Curtis Kuntz
*Assistant Examiner*—Ryan Robinson
(74) *Attorney, Agent, or Firm*—Edwards Angell Palmer & Dodge LLP; George N. Chaclas

(57) ABSTRACT

An improved driver assembly for a panel loudspeaker includes a retaining element for locating the voice coil with respect to the magnet assembly and forming a surface for removable attachment of the driving assembly to a radiating member. In a preferred embodiment, the retaining element is injection moulded from a hydrogel material with Shore A hardness in the range 0 to 20.

27 Claims, 3 Drawing Sheets

FOREIGN PATENT DOCUMENTS

| | | | | |
|---|---|---|---|---|
| WO | WO 02/074006 | | | 9/2002 |
| WO | WO 02/074006 | A2 | * | 9/2002 |
| WO | WO-02/076141 | A2 | | 9/2002 |
| WO | WO02074006 | A2 | * | 9/2002 |
| WO | WO 03/005764 | | * | 1/2003 |
| WO | WO 03/005764 | A2 | * | 1/2003 |

* cited by examiner

LOUDSPEAKER DRIVER ASSEMBLIES

This application is the U.S. national phase, pursuant to 35 U.S.C. §371, of international application No. PCT/GB2004/002588, published in English on Dec. 29, 2004 as international publication No. WO 2004/114717 A2, which claims the benefit of British application Ser. No. GB 0314007.6, filed Jun. 17, 2003, the disclosure of which applications are incorporated herein in their entireties by this reference.

The present invention relates improvements to loudspeaker driver assemblies and in particular to driver assemblies with retaining elements for panel loudspeakers.

Panel loudspeakers are becoming increasingly popular due to their low profile, practicality, low cost and improving sound quality.

Various constructional arrangements are available on the market, the majority of which include a driver assembly having a transducer for converting an electrical current into mechanical, pistonic movement. For distributed mode acoustic radiators, a panel has several nodes of movement. The rigid attachment of the transducer components to the panel alters the behaviour of the panel. In addition, the majority of the available arrangements require secure, permanent attachment in order to achieve adequate acoustic response. Although several attempts have to solve the above problems have been made, they have limitations in their acoustic response and are relatively expensive to produce.

It would therefore be desirable to provide an improved driver assembly that obviates or at least mitigates one or more of the drawbacks of the prior art.

According to a first aspect of the invention there is provided a driver assembly for a panel loudspeaker the driver assembly comprising a voice coil, a magnet assembly, and a moulded retaining element for retaining the magnet assembly with respect to the voice coil, wherein the moulded retaining element defines a first surface adapted to be coupled to panel forming an acoustic radiator.

Preferably, the moulded retainer consists of an elastomer material.

Preferably, the assembly further comprises a substantially rigid planar member attached to the voice coil, the planar member being disposed between the voice coil and said first surface.

According to a second aspect of the invention there is provided a driver assembly for a panel loudspeaker comprising a voice coil, a magnet-assembly, a retaining element for retaining the voice coil with respect to the magnet assembly, wherein the retaining element consists of an elastomer, and defines a first surface adapted to be coupled to a panel forming acoustic radiator.

Preferably, the elastomer is a hydrogel.

According to a third aspect of the invention there is provided a driver assembly for a panel loudspeaker comprising a voice coil, a magnet assembly, a substantially rigid planar member, a retaining element for retaining the voice coil with respect to the magnet assembly, wherein the retaining element defines a first surface adapted to be removably coupled to a panel forming an acoustic radiator, and the substantially rigid planar member is attached to the voice coil and is disposed between the voice coil and said first surface.

Preferably, the retaining element consists of a hydrogel.

Optionally, the retaining element consists of silicone.

The retaining element may consist of a material having a Shore A hardness in the range 0 to 20.

The retaining element may consist of a material having a Shore A hardness in the range 5 to 15.

The retaining element may consist of a material having a Shore A hardness of approximately 10.

Preferably, the retaining element functions to retain the voice coil and the magnet assembly in a spatially separated relationship.

Preferably, the retaining element consists of a single moulded-element.

Preferably, the first surface is adapted to be removably coupled to the panel forming the acoustic radiator.

Preferably, the magnet assembly comprises an axially extending central portion defining a first pole of a permanent magnet, a radially extending portion coupling the central portion to an axially extending magnetic shroud, the shroud defining a second pole of the permanent magnet, wherein the central portion and the shroud define a flux space therebetween.

More preferably, the voice coil extends into the flux space. The flux space may be annular.

Preferably, the retaining element comprises a disc defining the first surface. More preferably, the retaining element comprises a wall upstanding from an opposing surface of the disc.

Preferably, a volume defined by the retaining element accommodates the magnet assembly and the voice coil.

Preferably, the planar member is mounted adjacent said opposing surface of the disc.

Preferably, the wall has an inner diameter and an outer diameter, and the disc has a diameter greater than said outer diameter such that the disc defines a flange around the wall.

Preferably, said opposing surface of the disc is provided with one or more continuous ridges extending around the wall. More preferably, the continuous ridges are concentric with the wall.

Preferably, the wall is provided with a radially extending flange for engaging the magnet assembly.

Preferably, the outer diameter of the wall decreases in a direction away from the disc. The retaining element is therefore partially frusto-conical in shape.

According to a fourth aspect of the invention there is provided a retaining element for a panel loudspeaker driver assembly comprising a disc defining a first surface adapted to be removably coupled to an acoustic radiator, and a wall upstanding from an opposing surface of the disc and accommodating a voice coil and a magnet assembly in a spatially separated relationship.

According to a fifth aspect of the invention there is provided a method of mounting an acoustic radiator of a panel loudspeaker comprising the steps of:

- locating a voice coil and a magnet assembly in a moulded retaining element, and;
- removably attaching a surface defined by the moulded retaining element to a panel forming the acoustic radiator.

Preferably, the surface is removably attached to the panel by being placed in contact with the panel.

More preferably, the surface is removably attached to the panel without auxiliary fixing means.

Preferably, the surface has adhesive properties.

According to a sixth aspect of the invention there is provided a method of manufacturing a driving assembly for a panel loudspeaker, the method comprising the steps of:

- forming a retaining member by injection moulding, and;
- assembling a voice coil and magnet assembly in the retaining member.

There will now be described, by way of example only, various embodiments of the invention with reference to the accompanying drawings of which:

Figure 1:
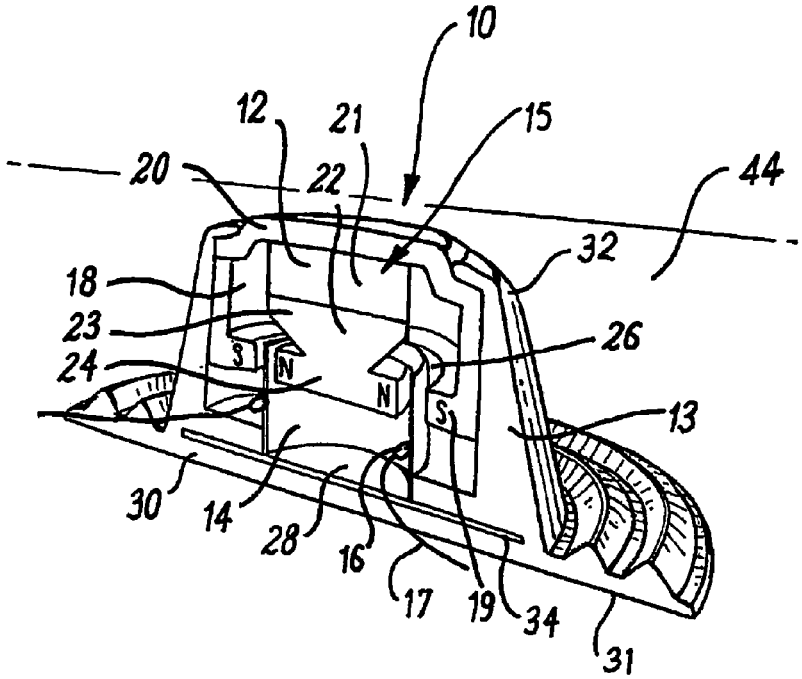
FIG. 1 is a perspective sectional view of a driver assembly in accordance with an embodiment of the invention, having a portion removed to display internal components.
Figure 3:
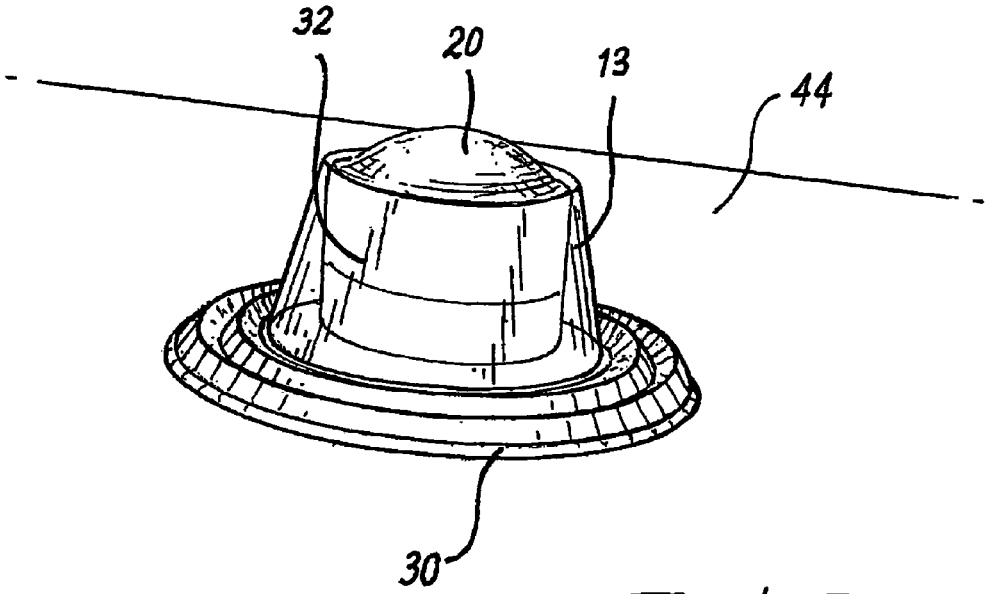
FIG. 3 is a perspective view of the driver assembly of FIGS. 1 and 2.
Figure 2:
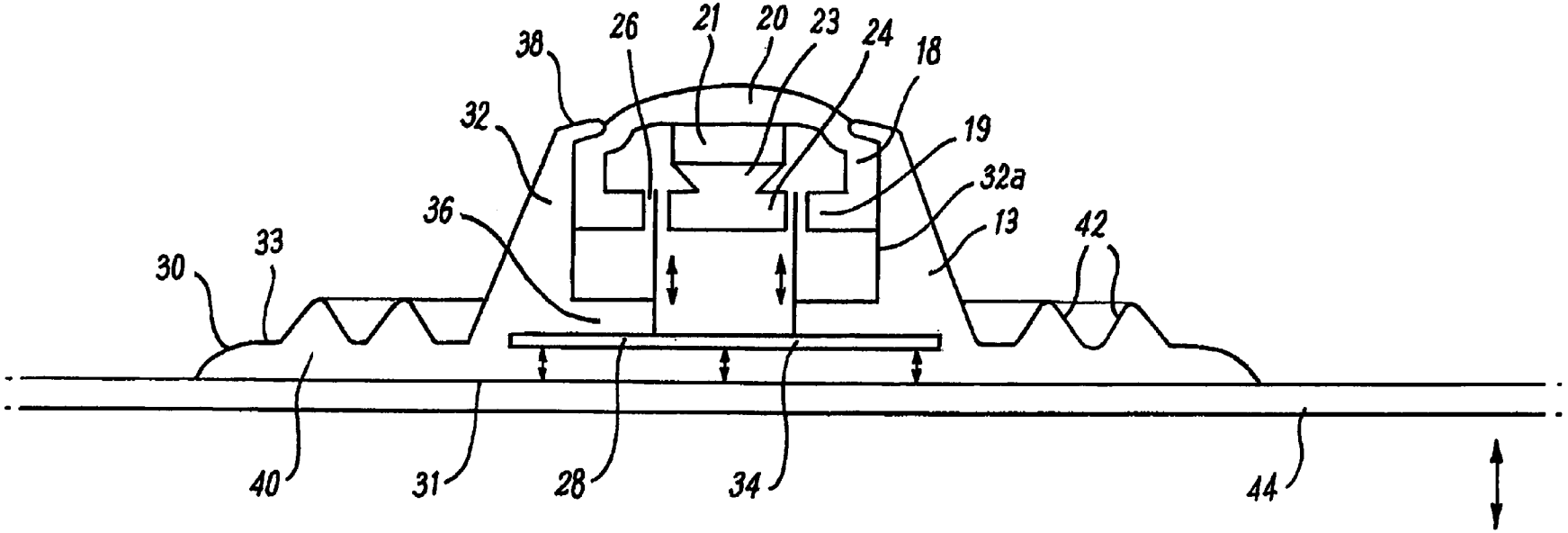
FIG. 2 is a cross-sectional view of the driver assembly of FIG. 1.

Referring to FIGS. 1 to 3 of the drawings, there is shown a driver assembly, generally depicted at 10, comprising a transducer 12 and a retaining element 13. The transducer 12 is of the moving-coil type, and includes a voice coil 14 and a magnet assembly 15.

The voice coil 14 consists of a hollow cylinder with a coil of conducting material secured thereto. Electrical connectors 16 are provided to provide electrical contact with a current source (not shown) via wires 17. The device is driven by alternating current (AC), and preferably has standard loudspeaker impedance characteristics (4, 6 or 8 Ohm) with power handling in the range from 0.5-100 W.

The magnet assembly 15 comprises a substantially cylindrical metallic outer sheath 18, and a circular metallic back plate 20. The sheath 18 is provided with an inwardly extending lip 19 of lesser inner diameter than the main body of the sheath. Centrally mounted in the back plate 20, internally to the sheath 18, is a cylindrical permanent magnet 21, mounted to the back plate 20 at one of its ends. On the opposing (lower) end of cylindrical magnet 21, there is provided an axially extending metallic portion 22. The axially extending metallic portion 22 comprises a frusto-conical portion 23, with outer diameter decreasing in a direction moving away from the back plate 20. The axially extending metallic portion 22 at its free end has a cylindrical portion 24 with greater outer diameter such that a flange is defined.

The geometry of the magnet assembly 15 is such that an annular air space 26 separates the inwardly extending lip 19 and the cylindrical portion 24. The cylindrical portion 22 defines one pole of a permanent magnet (shown as N), and the inwardly extending lip 19 defines the opposing pole of a permanent magnet (shown as S).

Magnetic flux is therefore concentrated in the annular region 26.

The voice coil 14 is securely mounted to a rigid planar pad 28, substantially concentrically with the pad 28.

The components of the transducer 12 are accommodated in the retaining element 13, which is moulded from an elastomeric material, which is preferably a silicone hydrogel. In this example, the material has a Shore A hardness of approximately 10. It has been found that materials having a Shore A hardness in the range 5 to 15 are particularly suitable, although materials with Shore A hardness in the range 0 to 20 could also be used effectively.

The retaining element 13 comprises a substantially planar disc 30 defining a planar (front) surface 31, and a circular surrounding wall 32 upstanding from an opposing (back) surface 33 of the disc.

The circular surrounding wall 32 has a varying outer diameter that decreases in a direction moving away from the disc 30. The retaining element therefore has a frusto-conical shape.

The disc 30 has a greater diameter than that of the surrounding wall 32, such that the disc defines a flange 40 around the wall. The opposing (back) surface 33 is provided with a pair of continuous concentric circular ridges 42, located around the surrounding wall 32. The ridges 42 allow an increased degree of axial flexibility of the disc, while retaining a certain amount of stiffness against flexing about diametric lines and/or chords.

The internal diameter of the retaining element 13 differs at different axial positions of the element in order to accommodate the different components of the transducer. The rigid pad 28 is placed adjacent the opposing surface 33 of the disc, approximately concentrically with the disc and with the internal volume defined by the surrounding wall 32. The rigid pad is thus disposed between the voice coil and the disc 30. The rigid pad 28 has a diameter less than the outer diameter of the surrounding wall 32, but greater that the inner diameter of the main portion 32*a* of the surrounding wall. A shallow annular slot 34 is therefore provided to accommodate the rigid pad 28. Preferably the depth and diameter of the annular slot 34 corresponds closely to the thickness and diameter of the of the rigid pad 28, in order that the retaining element holds the rigid pad reasonably tightly.

Behind the rigid pad 28 (moving in a direction from the front surface 31 of the disc to the back plate 20), the surrounding wall is provided with a portion of decreased inner diameter, such that an inwardly extending ring 36 is defined. The inner diameter of the ring 36 corresponds to the outer diameter of the voice coil 14.

The inner diameter of the main portion 32*a* of the surrounding wall 32 corresponds to the outer diameter of the sheath 18 of the magnet assembly 15. The magnet assembly 15 and the voice coil 14 are held by the retaining element in an aligned, spatially separated relationship. The positioning of the components is such that the voice coil extends axially into the annular space 26 in the magnet assembly. The coil is therefore located in the region of concentrated magnetic flux.

At the back end of the surrounding wall 32, an inwardly extending ring 38 is provided to engage with a circumferential portion of the back plate. A central area of the back plate is exposed, and may protrude through the aperture defined by the inwardly extending ring 38. The aperture provides access to the internal components of the driver assembly. In conjunction with the physical properties of the hydrogel material, the geometry of the retaining element 13 allows the retaining element to be temporarily stretched to allow assembly of, access to and removal of the transducer components.

In use, the front surface 31 of the disc 30 is coupled to a panel 44 to be used as an acoustic radiator. The choice of a hydrogel material for the disc reduces the reliance on auxiliary fixing means, such as a mechanical fixing, bonding or adhesive. The planar front surface of hydrogel material has inherent adhesive properties arising from the chemical make up of the material. This adhesion is adequate for removably attaching the driver assembly a wide range of rigid panels without using an auxiliary fixing mechanism or agent. The driver assembly will remain securely attached to the panel during use, with excellent acoustic coupling. After use, or if the position of the driver assembly is to be changed, it can be removed from the panel by simply peeling or pulling the driver assembly away from the panel. The panel can be repositioned immediately in the same manner.

When coupled to any of a variety of panels, the driver assembly to produce a distributed mode speaker with good acoustic response characteristics. Since the coil 14 is located in the annular space 26, at which the magnetic flux of the magnet assembly 15 is concentrated, the application of an alternating current to the coil imparts a relative axial movement between the coil and the magnet. The retaining element 13 limits the axial expansion of the driver assembly, in a rearward direction, and thus the relative movement manifests itself as an axial movement of the voice coil 14. The voice coil imparts movement to the rigid pad 28, which transmits the mechanical movement to the panel 44 via the disc 30.

The geometry of the retaining element is such that it directs the major mechanical movement to the area where there is contact with the panel 44, improving the movement in this side of the drive assembly, and minimising or effectively cancelling the movement on the back side of it.

Figure 4:
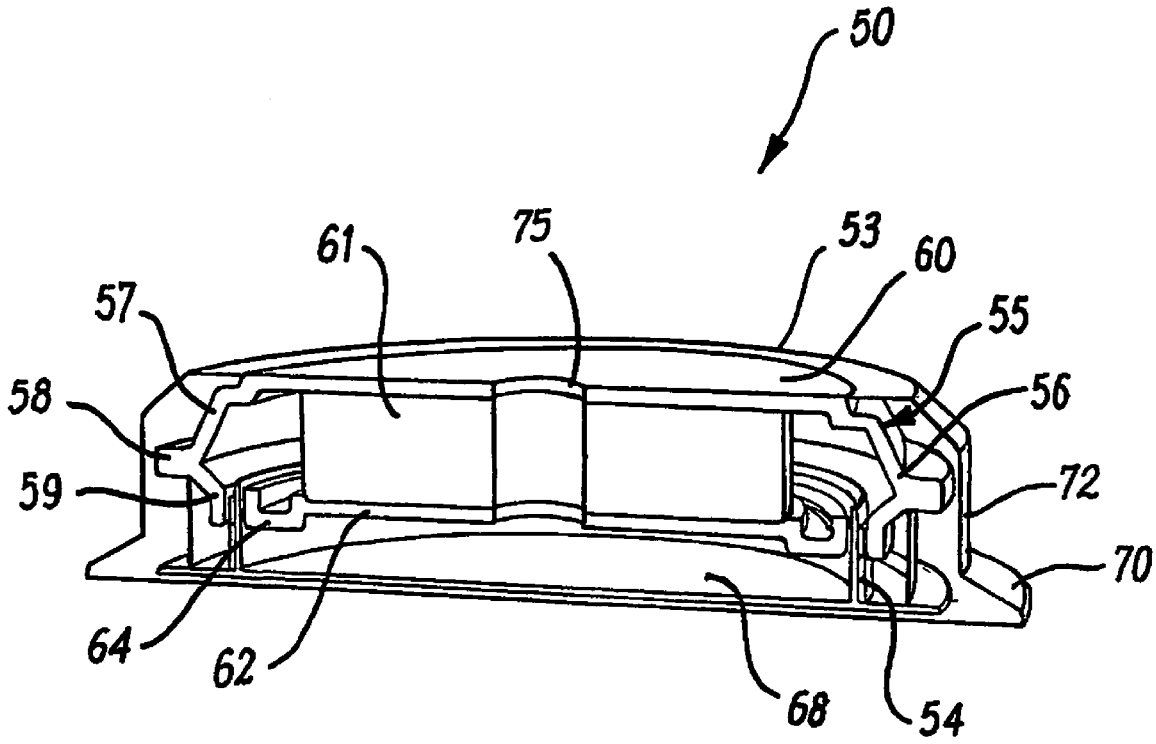
FIG. 4 is a perspective sectional view of a driver assembly in accordance with an alternative embodiment of the invention, having a portion removed to display internal components.

FIG. 4 shows a driver assembly in accordance with an alternative embodiment of the invention. This embodiment is similar to that shown in FIGS. 1 to 3, although it has constructional and geometrical differences.

FIG. 4 shows a driver assembly, generally depicted at 50, comprising a voice coil 54, a magnet assembly 55 and a retaining element 53.

The magnet assembly 55 comprises a metallic outer sheath 58, and a circular metallic back plate 60. The sheath 56 has an outwardly extending rim 58 which separates frusto-conical back portion 57 and an inwardly extending lip 59 of lesser inner diameter than the main body of the sheath. Centrally mounted in the back plate 60, internally to the sheath 56, is a cylindrical permanent magnet 61, mounted to the back plate 60 at one of its ends. On the opposing (lower) end of cylindrical magnet 61, there is provided an extending metallic portion 62 with a shaped rim 64 defining a flange.

As with the embodiment of FIGS. 1 to 3, the geometry of the magnet assembly 55 is such that an annular air space in which magnetic flux is concentrated.

Also as before, the voice coil 54 is securely mounted to a rigid planar pad 68, substantially concentrically with the pad 68, and the components are retained in the elastomeric retaining element 53. The retaining element 53 comprises a substantially planar disc 70 defining a planar (front) surface, and a circular surrounding wall 72 upstanding from an opposing (back) surface of the disc.

The retaining element, which preferably is a silicone material as described with reference to FIGS. 1 to 3, fits over and around the back portion 57 of the sheath 58. In this example, the rim 58 is received in a groove in the retaining element. The cooperation of the rim and groove assists in the maintaining the components in an appropriate spatial relationship.

In contrast to the embodiment of FIGS. 1 to 3, the magnet assembly is provided with a bore 75 extending through the back plate 60, the magnet 61 and the metallic portion 62. In this example, the bore is concentric with the other components of the apparatus. Electrical connections 76 to the voice coil 54 to pass through the bore and out to the audio apparatus providing the audio signal.

The principles of operation of the embodiment of FIG. 4 are the same as those described with reference to FIG. 1 to 3.

One function of the hydrogel retaining element is the transmission of energy from voice coil vibrations, which have relatively large amplitude, to panel vibrations of relatively small amplitude across a bigger surface area of the panel. This is facilitated by the provision of a disc to give a large contact area between the driver assembly and the panel. Consequently, the driver assembly turns a larger proportion of the panel into a loudspeaker and therefore produces a high quality sound in the high, medium and low frequency ranges. Compared with prior art arrangements, the present invention performs particularly well in the mid- to low-frequency ranges.

In addition, the retaining element provides a flexible connection between the transducer and the panel, without restricting the vibrations of the panel in the same manner as many prior art systems.

In accordance with one embodiment of the invention, the driver assembly is manufactured by:

(i) forming a retaining element from a hydrogel by an injection moulding process (ii) assembling a transducer from a magnet assembly and a voice coil with the retaining element.

The rigid pad 28 could be inserted into the retaining element after injection moulding, or alternatively the injection moulding could take place around a pre-positioned rigid pad.

The present invention in its various aspects provides numerous advantages over the prior art arrangements.

Firstly, the flexibility of the hydrogel transmits mechanical movement of the transducer to the panel without constraining its own modes of movement, which ensures an accurate sound fidelity.

The flexible attachment allows movement at the contact point between the driver assembly and the panel mitigating panel stress and damage.

The assembly avoids the need for a spider for mounting the magnet assembly centrally with respect to the voice coil.

The retaining element aligns the movement of the voice coil, and minimises the stress to the coil and rattling caused by misalignment.

The retaining element aids heat dissipation and protects the panel from overheating.

The driving assembly is compatible with a wide range of rigid panels, due to the avoidance of bonding the transducer to the panel.

The improved alignment of the transducer parts allows manufacture of the transducer with a small annular space between the voice coil and the magnet assembly, improving transducer efficiency.

Due to the non-bonded attachment of the transducer to the panel, the weight of the panel is not supported by the drive assembly.

The driver assembly has the ability of produce high quality sound at frequencies of between 50 to 18000 Hz using only one transducer.

The retaining element keeps all component parts together, but at the same time gives some flexibility to the structure of the product.

The driver assembly has improved load bearing characteristics.

The driver assembly and retaining element of the present invention is able to function on a wide range of surfaces such as foam tiles, display boards, metal, glass and plastics. The properties and the manufacturing process of the hydrogel render the unit flexible due to the way it is fixed to a panel within seconds and can be attached and re-attached without damage to the panels/displays, and without an auxiliary fixing agent or mechanism.

The technology can be used wherever space is limited, or external access to transducer components is to be avoided. The flexibility of the assembly gives rise to numerous applications of the technology as follows:

Audio/visual products.
Ceiling tile installations.
Hifi manufacturers/retailers.
Mobile telephones.
Boating and leisure industries.
Vandal-proof requirements and security.
Clean rooms.
Military.
ATMs, interactive kiosks.
Mobile audio/concerts.

Particular applications to audio systems in public areas are envisaged, for example to advertising displays with audio capability. The driver assembly may be mounted to a rear surface of a display board, and connected to a source of audio data such as a combined MP3 player and amplifier. A proximity detector, such as an infrared detector, may be provided to activate the system in response to an indication that a person is in the vicinity of the display.

It will be appreciated by one skilled in the art that various modifications and improvements could be made within the scope of the invention herein intended.

The invention claimed is:

1. Driver apparatus for driving a distributed mode loudspeaker, the driver apparatus comprising:

an actuator operable to move in dependence on an acoustic signal, the actuator comprising a voice coil, a magnet assembly and a substantially rigid planar member coupled to the voice coil and arranged for axial movement with respect to the magnet assembly; and a coupler formed of a unitary resilient material which covers the planar member and is connected to move with the planar member, the coupler being configured to, in use, couple movement of the actuator to an acoustic radiator to cause the acoustic radiator to operate in a distributed mode fashion, in which the coupler has a Shore A hardness of no more than 20.

2. Apparatus according to claim 1, in which the coupler engages with the actuator.

3. Apparatus according to claim 1, in which the coupler is configured to engage with the acoustic radiator.

4. Apparatus according to claim 1, in which the coupler defines a substantially planar surface configured to engage with a surface of the acoustic radiator.

5. Apparatus according to claim 1, in which the actuator is operative in dependence upon an electrical signal.

6. Apparatus according to claim 1, in which the actuator comprises a moving coil actuator.

7. Apparatus according to claim 1, in which the resilient material comprises a polymer.

8. Apparatus according to claim 1, in which the resilient material comprises a gel.

9. Apparatus according to claim 1, in which the coupler defines a substantially planar surface that is configured to removably engage with a surface of the acoustic radiator.

10. Apparatus according to claim 1, the coupler being configured to retain the magnet assembly with respect to the voice coil, the coupler defining a first surface configured to be removably coupled to the acoustic radiator, and the substantially rigid planar member being attached to the voice coil and being disposed between the voice coil and the first surface.

11. Apparatus according to claim 8, in which the gel comprises a hydrogel.

12. Apparatus according to claim 1, in which the coupler has a Shore A hardness between substantially 5 and substantially 15.

13. Apparatus according to claim 1, in which the coupler has a Shore A hardness of substantially 10.

14. Apparatus according to claim 10, in which the coupler is operative to retain the voice coil and the magnet assembly in a spatially separated relationship.

15. Apparatus according to claim 10, in which the coupler consists of a single moulded element.

16. Apparatus according to claim 10, in which the magnet assembly comprises an axially extending central portion defining a first pole of a permanent magnet and a radially extending portion coupling the central portion to an axially extending magnetic shroud, the shroud defining a second pole of the permanent magnet and the central portion and the shroud defining a flux space therebetween.

17. Apparatus according to claim 16, in which the voice coil extends into the flux space.

18. Apparatus according to claim 16, in which the flux space is substantially annular.

19. Apparatus according to claim 10, in which the coupler comprises a disc defining the first surface.

20. Apparatus according to claim 19, in which the coupler comprises a wall upstanding from an opposing surface of the disc.

21. Apparatus according to claim 10, in which a volume defined by the coupler accommodates the magnet assembly and the voice coil.

22. Apparatus according to claim 20, in which the planar member is mounted adjacent said opposing surface of the disc.

23. Apparatus according to claim 20, in which the wall has an inner diameter and an outer diameter, and the disc has a diameter greater than said outer diameter such that the disc defines a flange around the wall.

24. Apparatus according to claim 20, in which the opposing surface of the disc is provided with at least one continuous ridges extending around the wall.

25. Apparatus according to claim 24, in which the at least one continuous ridge is concentric with the wall.

26. Apparatus according to claim 20, in which the wall is provided with a radially extending flange for engaging the magnet assembly.

27. Apparatus according to claim 20, in which an outer diameter of the wall decreases in a direction away from the disc.

* * * * *